US007644817B2

(12) United States Patent
Sutherland

(10) Patent No.: US 7,644,817 B2
(45) Date of Patent: Jan. 12, 2010

(54) WRAP-AROUND CARRIER AND BLANK

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 409 days.

(21) Appl. No.: 11/491,429

(22) Filed: Jul. 21, 2006

(65) Prior Publication Data

US 2007/0017839 A1 Jan. 25, 2007

Related U.S. Application Data

(60) Provisional application No. 60/701,644, filed on Jul. 22, 2005.

(51) Int. Cl.
*B65D 71/00* (2006.01)

(52) U.S. Cl. ..... 206/427; 206/147; 206/139

(58) Field of Classification Search ..... 206/427, 206/139, 140, 170, 141, 147, 434; 229/103.2, 229/89, 185

See application file for complete search history.

(56) References Cited

U.S. PATENT DOCUMENTS

| | | | | |
|---|---|---|---|---|
| 2,849,111 | A | 8/1958 | Fielding | |
| 2,928,541 | A | 3/1960 | Fielding | |
| 3,306,519 | A * | 2/1967 | Wood | 206/140 |
| 3,339,723 | A | 9/1967 | Wood | |
| 3,373,867 | A | 3/1968 | Wood | |
| 3,593,849 | A | 7/1971 | Helms | |
| 3,635,452 | A | 1/1972 | Helms | |
| 3,669,342 | A | 6/1972 | Funkhouser | |
| 3,747,835 | A | 7/1973 | Graser | |
| 3,767,042 | A | 10/1973 | Ganz | |
| 3,963,121 | A | 6/1976 | Kipp | |
| 4,010,593 | A | 3/1977 | Graham | |
| 4,101,069 | A | 7/1978 | Wood | |
| 4,202,446 | A | 5/1980 | Sutherland | |
| 4,328,893 | A | 5/1982 | Oliff et al. | |
| 4,424,901 | A | 1/1984 | Lanier | |
| 4,440,340 | A * | 4/1984 | Bakx | 206/155 |
| 4,566,593 | A | 1/1986 | Muller | |
| 4,747,487 | A | 5/1988 | Wood | |
| 4,875,585 | A | 10/1989 | Kadleck et al. | |
| 4,966,324 | A | 10/1990 | Steel | |
| 4,972,991 | A | 11/1990 | Schuster | |
| 5,042,660 | A | 8/1991 | Carver | |
| 5,060,792 | A | 10/1991 | Oliff | |
| 5,131,588 | A | 7/1992 | Oliff | |
| 5,180,100 | A | 1/1993 | Shimizu | |
| 5,195,676 | A * | 3/1993 | LeBras | 206/429 |
| 5,246,112 | A * | 9/1993 | Stout et al. | 206/427 |
| 5,297,673 | A | 3/1994 | Sutherland | |

(Continued)

FOREIGN PATENT DOCUMENTS

| | | |
|---|---|---|
| BE | 671 762 | 3/1966 |

(Continued)

*Primary Examiner*—Mickey Yu
*Assistant Examiner*—Steven A. Reynolds
(74) *Attorney, Agent, or Firm*—Womble Carlyle Sandridge & Rice, PLLC

(57) ABSTRACT

A wrap-around carrier has side end panels that facilitate erection of the carrier and closure of the carrier ends.

32 Claims, 6 Drawing Sheets

U.S. PATENT DOCUMENTS

| | | | |
|---|---|---|---|
| 5,351,878 | A | 10/1994 | Cooper |
| 5,472,090 | A | 12/1995 | Sutherland |
| 5,472,138 | A | 12/1995 | Ingram |
| 5,542,536 | A | 8/1996 | Sutherland |
| 5,551,556 | A | 9/1996 | Sutherland |
| 5,558,212 | A | 9/1996 | Sutherland |
| 5,558,213 | A | 9/1996 | Sutherland |
| 5,597,071 | A | 1/1997 | Sutherland |
| 5,609,251 | A | 3/1997 | Harris |
| 5,664,401 | A | 9/1997 | Portrait et al. |
| 5,682,995 | A | 11/1997 | Sutherland |
| 5,692,614 | A | 12/1997 | Harris |
| 5,778,630 | A | 7/1998 | Portrait et al. |
| 5,853,088 | A | 12/1998 | Saulas et al. |
| 5,855,318 | A | 1/1999 | Baxter |
| 5,931,300 | A | 8/1999 | Sutherland |
| 5,937,620 | A | 8/1999 | Chalendar |
| 5,941,453 | A | 8/1999 | Oliff |
| 5,943,847 | A | 8/1999 | Chalendar |
| 5,947,367 | A | 9/1999 | Miller et al. |
| 5,975,286 | A | 11/1999 | Oliff |
| 6,019,220 | A | 2/2000 | Sutherland |
| 6,021,898 | A | 2/2000 | Sutherland |
| 6,021,899 | A | 2/2000 | Sutherland |
| 6,109,438 | A | 8/2000 | Sutherland |
| 6,158,586 | A | 12/2000 | Muller |
| 6,289,651 | B1 | 9/2001 | Le Bras |
| 6,315,123 | B1 | 11/2001 | Ikeda |
| 6,550,616 | B2 | 4/2003 | Le Bras |
| 6,811,525 | B2 | 11/2004 | Culpepper |
| 6,948,651 | B2 | 9/2005 | Ikeda |
| 6,981,631 | B2 | 1/2006 | Fogle et al. |
| 7,159,759 | B2 * | 1/2007 | Sutherland ..... 229/103.2 |
| 2003/0000182 | A1 | 1/2003 | Portrait et al. |
| 2003/0132130 | A1 | 7/2003 | Le Bras |
| 2004/0243277 | A1 | 12/2004 | Bonnain et al. |
| 2004/0254666 | A1 | 12/2004 | Bonnain et al. |
| 2005/0001020 | A1 | 1/2005 | Garnier |
| 2006/0191811 | A1 | 8/2006 | Fogle et al. |

FOREIGN PATENT DOCUMENTS

| | | | |
|---|---|---|---|
| DE | 91 04 905.9 | | 6/1991 |
| DE | 92 03 858.1 | | 5/1992 |
| EP | 0 459 658 | A1 | 12/1991 |
| EP | 0 509 749 | A1 | 10/1992 |
| EP | 0520 411 | A1 | 12/1992 |
| FR | 2 698 074 | | 5/1994 |
| WO | WO 97/27124 | | 7/1977 |
| WO | WO 02/102208 | A1 | 12/2002 |
| WO | WO 03/008292 | A2 | 1/2003 |
| WO | WO 2005/042370 | A1 | 12/2005 |

* cited by examiner

WRAP-AROUND CARRIER AND BLANK

RELATED APPLICATION

This application claims the benefit of U.S. Application No. 60/701,644, filed Jul. 22, 2005, the entire contents of which are hereby incorporated by reference.

BACKGROUND

Wrap-around carriers are formed by wrapping a blank around a group of containers and securing the ends of the blank together. The containers are held in place by the tightly wrapped carrier and also by heel cutouts through which bottom portions of the containers extend. Conventional carriers, have open ends that typically do not sufficiently enclose the containers. Conventional carriers may also be difficult to erect.

SUMMARY

According to a first embodiment of the invention, a carrier package comprises a carton and a plurality of containers. The carton comprises a top panel, a first upper side panel, a second upper side panel, a first lower side panel, a second lower side panel, a bottom panel, a first end closure at a first end of the carrier, and a second end closure at a second end of the carrier. The end closures can include a side end flaps foldably connected to respective lower side panels, the side end flaps having bottom edges located adjacent to the bottom panel. During erection of the carton, the bottom edges of the side end flaps may serve to bring the carton into a desired shape (e.g., "squaring up" the carton). The side end flaps and top end closures serve to substantially enclose the ends of the carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to carriers for articles. The articles can also include beverage containers such as, for example, beverage bottles, PET containers, or other containers such as those used in packaging foodstuffs. For the purposes of illustration and not for the purpose of limiting the scope of the present invention, the following detailed description describes bottle beverage containers as disposed within the carton embodiments. In this specification, the relative terms "lower," "bottom," "side," "upper" and "top" indicate orientations determined in relation to fully erected cartons.

Figure 1:
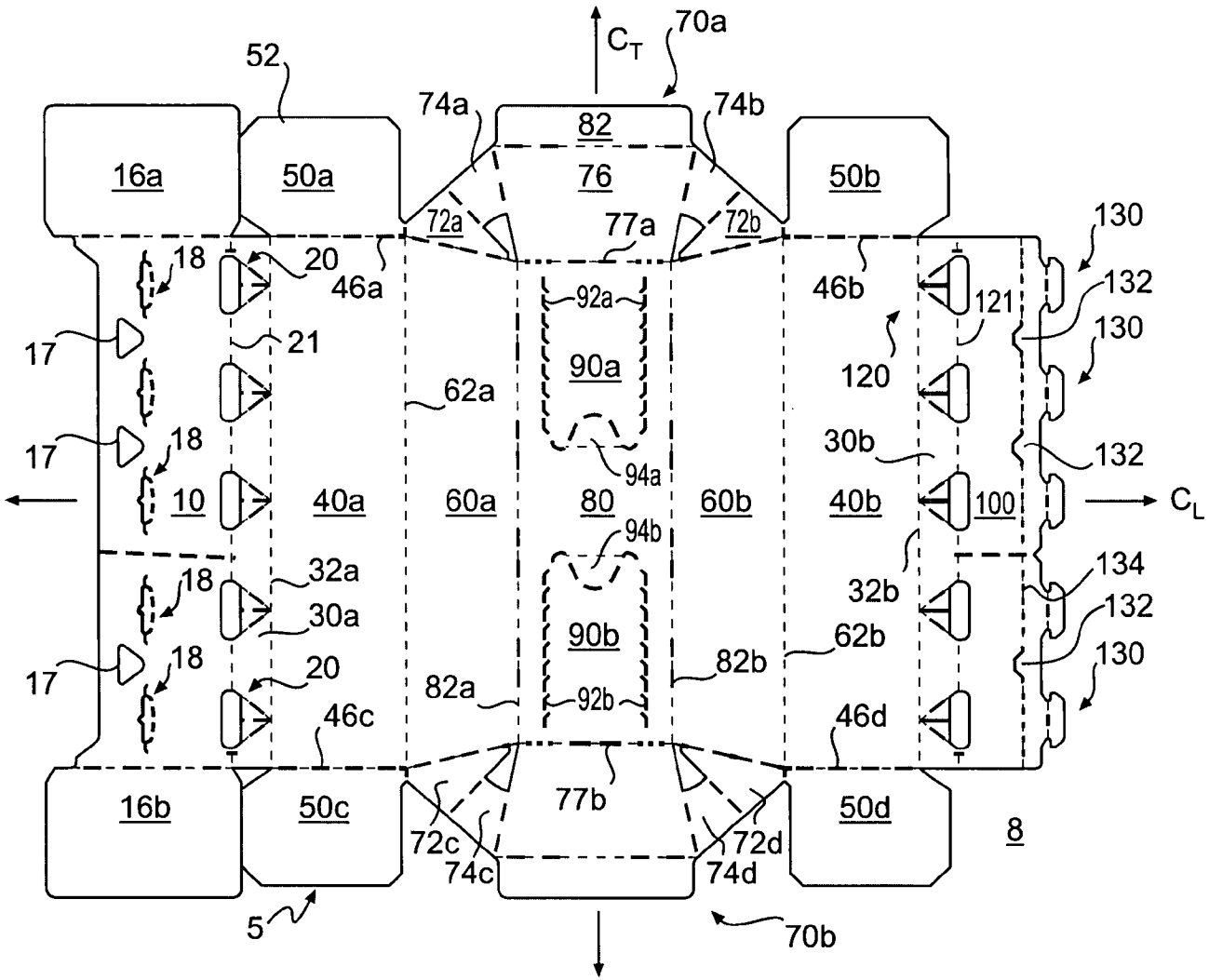
FIG. 1 is a plan view of a first side of a blank used to form a carrier according to a first embodiment of the invention.

FIG. 1 is a plan view of a first, interior side 5 of a blank 8 used to form a carrier 150 (illustrated in FIGS. 5-7) according to a first embodiment of the invention. The first side 5 of the blank 8 will be disposed in the interior of the erected carrier 150. As shown in FIG. 1, the blank 8 may be symmetric or nearly symmetric about a longitudinal center line $C_L$, and partially symmetric about a transverse center line $C_T$. Therefore, certain elements in the drawing figures are indicated by like or similar reference numerals in order to reflect the longitudinal and/or transverse symmetries.

The blank 8 comprises a first bottom panel 10 foldably connected to a first lower side panel 40*a* at a transverse fold line 21, a first upper side panel 60*a* foldably connected to the first lower side panel 40*a* at a transverse fold line 62*a*, a top panel 80 foldably connected to the first upper side panel 60*a* at a transverse fold line 82*a*, a second upper side panel 60*b* foldably connected to the top panel 80 at a transverse fold line 82*b*, a second lower side panel 40*b* foldably connected to the second upper side panel 60*b* at a transverse fold line 62*b*, and a second bottom panel 100 foldably connected to the second lower side panel 40*b* at transverse fold line 121. The first lower side panel 40*a* can include a first bevel panel 30*a* defined by parallel transverse fold lines 21 and 32*a*. The second lower side panel 40*b* can include a second bevel panel 30*b* defined by parallel transverse fold lines 121 and 32*b*.

First and second bottom end flaps 16*a*, 16*b* are foldably connected to opposite ends of the first bottom panel 10. First and third side end flaps 50*a*, 50*c* are foldably connected to opposite ends of the first lower side panel 40*a* at longitudinal fold lines 46*a*, 46*c*, respectively, and second and fourth side end flaps 50*b*, 50*d* are foldably connected to opposite ends of the second lower side panel 40*b* at longitudinal fold lines 46*b*, 46*d*, respectively. One or more of the side end flaps 50*a*-50*d* may be shaped and sized to facilitate erection of the carrier 150, as discussed in further detail below with reference to FIG. 2.

A first top end closure 70*a* is disposed along a first marginal area of the blank 8 and is foldably connected to the first and second upper side panels 60*a*, 60*b* and the top panel 80 along a fold line 77*a*. The first top end closure 70*a* includes a top end flap 76, an adhesive flap 82 foldably connected to the top end flap 76, a first inner tuck-in gusset panel 72*a* foldably connected to the first upper side panel 60*a*, a first outer tuck-in gusset panel 74*a* foldably connected to the first inner tuck-in gusset panel 72*a* and foldably connected to the top end flap 76, a second inner tuck-in gusset panel 72*b* foldably connected to the second upper side panel 60*b*, and a second outer tuck-in gusset panel 74*b* foldably connected to the first inner tuck-in gusset panel 72*b* and to the top end flap 76. A second top end closure 70*b* is disposed along a second marginal area of the blank 8 and is foldably connected along a fold line 77*b*. The second top end closure 70*b* may have a configuration similar or identical to that of the first top end closure 70*a*.

The top panel 80 may include first and second dispenser flaps 90*a*, 90*b* defined by breachable lines of disruption in the top panel. The first and second dispenser flaps 90*a*, 90*b* extend along the top panel 80 adjacent to the top end closures 70*a*, 70*b*, respectively. The first dispenser flap 90*a* is defined by a tear line 92*a*, and may include an access flap 94*a* at one end to facilitate opening of the dispenser flap 90*a*. The second dispenser flap 90*b* is defined by a tear line 92*b* and may include an access flap 94*b*.

The first bottom panel 10, which is the inner bottom panel flap in the completed carrier 150, includes cutouts forming primary female locking edges 17 that are adapted to engage primary male locking tab projections 132 on the second bottom panel 100. The first bottom panel 10 also includes slits 18 adapted to receive outer secondary locking tab projections 130 of the second bottom panel 100. The second bottom panel 100, which is the outer bottom panel in the completed carrier 150, includes a transverse fold line 134 which is interrupted by the slits that define the primary male locking tab projections 132. Although the locking elements of the blank 8 are illustrated to demonstrate a typical bottom panel locking arrangement suitable for use with the carrier of the invention, it should be understood that any desired effective form of bottom panel locking means may be employed.

Heel cutouts 20 can be cut into the first bottom panel 10 and the first bevel panel 30*a*. Each heel cutout 20 is sized to receive a bottom peripheral edge of a container C loaded in the carrier 150. Similarly, heel cutouts 120 can be cut into the second bottom panel 100 and the second bevel panel 30*b*. In FIG. 1, the blank 8 includes five heel cutouts in each bottom panel 10, 100, which are arranged to accommodate ten containers C in a 2×5 (two columns and five rows) arrangement.

Figure 2:
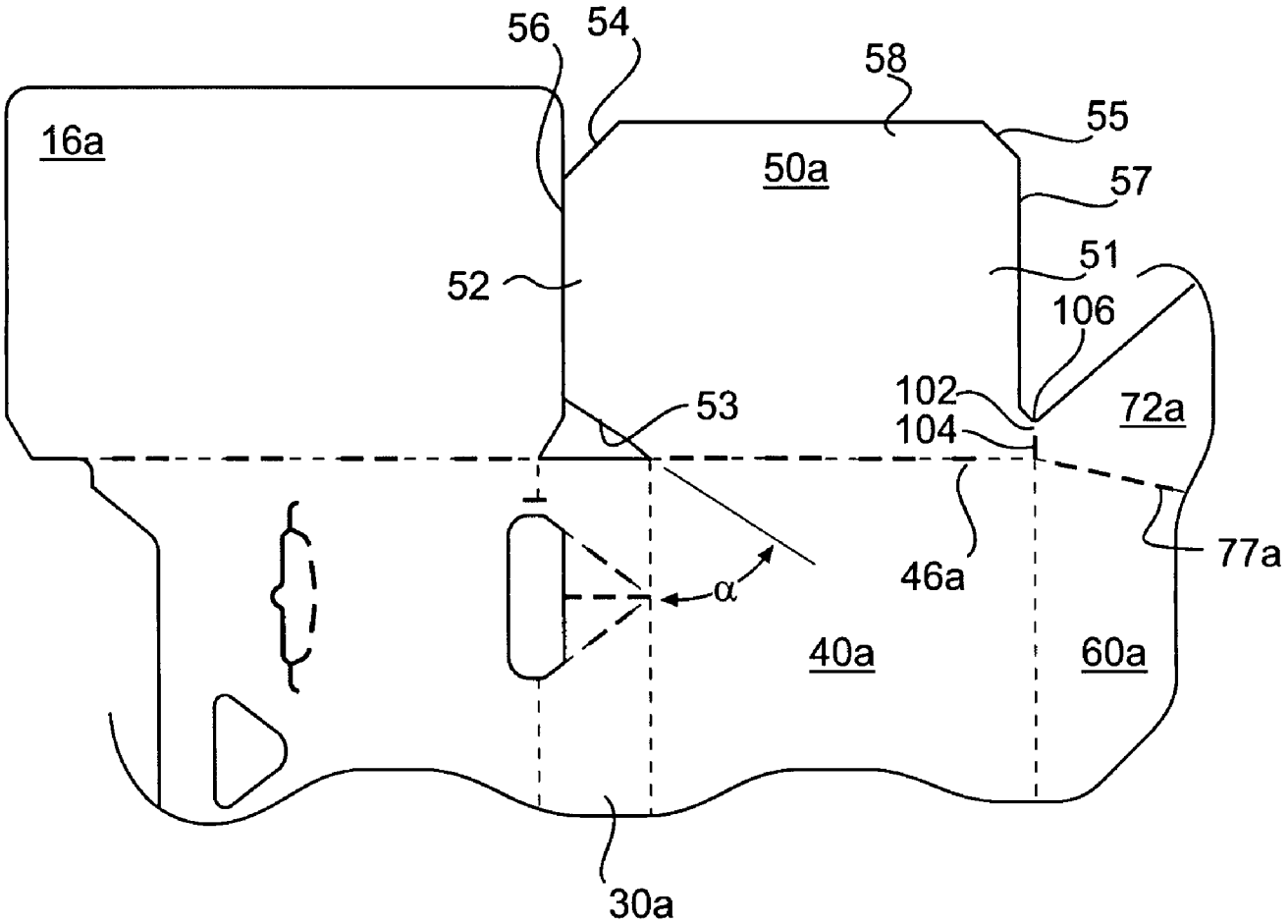
FIG. 2 is a detailed view of a portion of the carrier blank.

According to one aspect of the present invention, the end flaps 50*a*-50*d*, 16*a*, 16*b* and top end closures 70*a*, 70*b* may be configured wholly or substantially enclose the ends of the carton 150 and to facilitate erection of the carton. FIG. 2 illustrates the first side end flap 50*a* in detail. The side end flaps 50*b*-50*d* may have a similar configuration and are not discussed in detail for the sake of brevity. The first side end flap 50*a* is foldably connected to the first lower side panel 40*a* at the longitudinally extending fold line 46*a*. The side end flap 50*a* has a base portion 51 and a projecting portion 52. The projecting portion 52 is defined in part by angled or beveled corners 53, 54, and a bottom edge 56. The beveled corners 53, 54 provide the projecting portion 52 with a plan surface area that tapers away from the base portion 51. The base portion 51 also has a beveled or angled upper corner 55 adjacent to an upper edge 57. The projecting portion 52 facilitates closure of the carton ends, as will be discussed in further detail below.

As discussed below with reference to FIG. 9, the inclined corner 53 of the first side end flap 50*a* may be inclined with respect to the fold line 46*a* at an angle α that may generally approximate or be smaller than the angle that the bevel panel 30*a* has with respect to vertical in the erected carrier 150. The bottom edge 56 may be immediately adjacent to the first bottom end flap 16*a*, and the separation between the first bottom end flap 16*a* and the first side end flap 50*a* may be, for example, a cut line. The cut line between the flap 16*a* and the first side end flap 50*a* may be located, in relation to the longitudinal direction, between the fold lines 21 and 32*a* that define the first bevel panel 30*a*. The location of the cut line, and therefore the location of the bottom edge 56 of the first side end flap 50*a*, may be selected so that the bottom edge 56 is located a desired distance from a bottom panel of the erected carrier 150. The distance may be selected, for example, to achieve a desired ease of closing of the ends of the carrier.

A nick 102 and a cut 104 are located at the fold connection of the first side end flap 50*a* to the first inner tuck-in gusset panel 72*a*. Immediately above the nick 102, the edge of the blank 8 may have a small radius 106 adjacent to the nick 102. The connections of the side end flaps 50*b*, 50*c*, 50*d* to their respective inner tuck-in panels 72*b*, 72*c*, 72*d* may also be a nick-cut connection as shown in FIG. 2. The nicks 102, cuts 104 and radii 106 at each foldable connection facilitate inward folding of the panels 72*a*, 72*b*, 72*c*, 72*d*, 74*a*, 74*b*, 74*c*, 74*d* during erection of the carton 150, as discussed in further detail below.

Erection of the carton 150 will now be discussed with reference to FIGS. 1-6. The containers C are initially arranged in a 2×5 configuration, and the blank 8 is lowered onto the containers C until the top panel 80 contacts the tops of the containers C. The sides of the blank 8 are then folded inwardly until the bottoms of the containers C are partially held within the heel cutouts 20, 120. The partially erected carton and containers are then rotated 90 degrees so that the first and second bottom panels 10, 100 may be interlocked. The bottom panels 10, 100 are secured by engaging the primary female locking edges 17 of the first bottom panel 10 with the primary male locking tabs 132 of the second bottom panel 100. The outer secondary locking tabs 130 of the second bottom panel 100 are then pressed into the slits 18.

Figure 3:
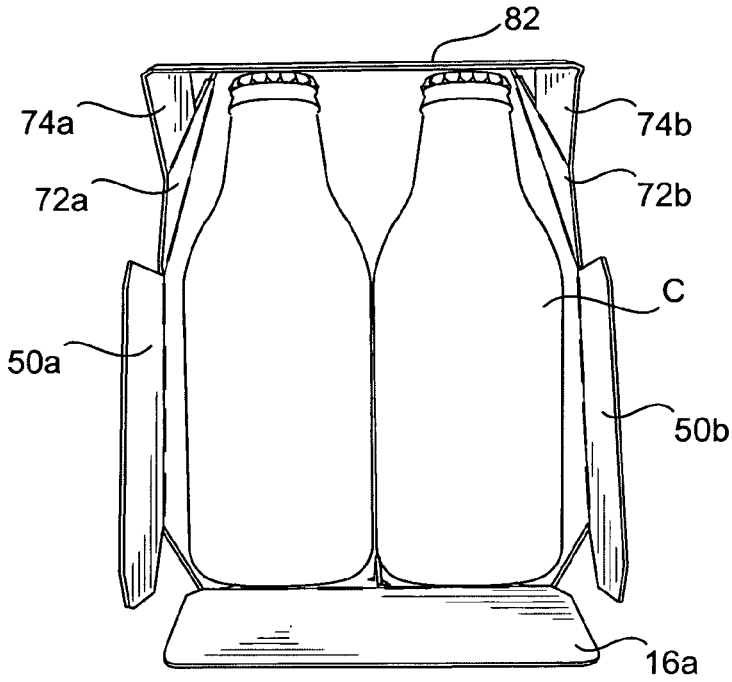
FIGS. 3-5 illustrate erection and loading of the carrier.
Figure 4:
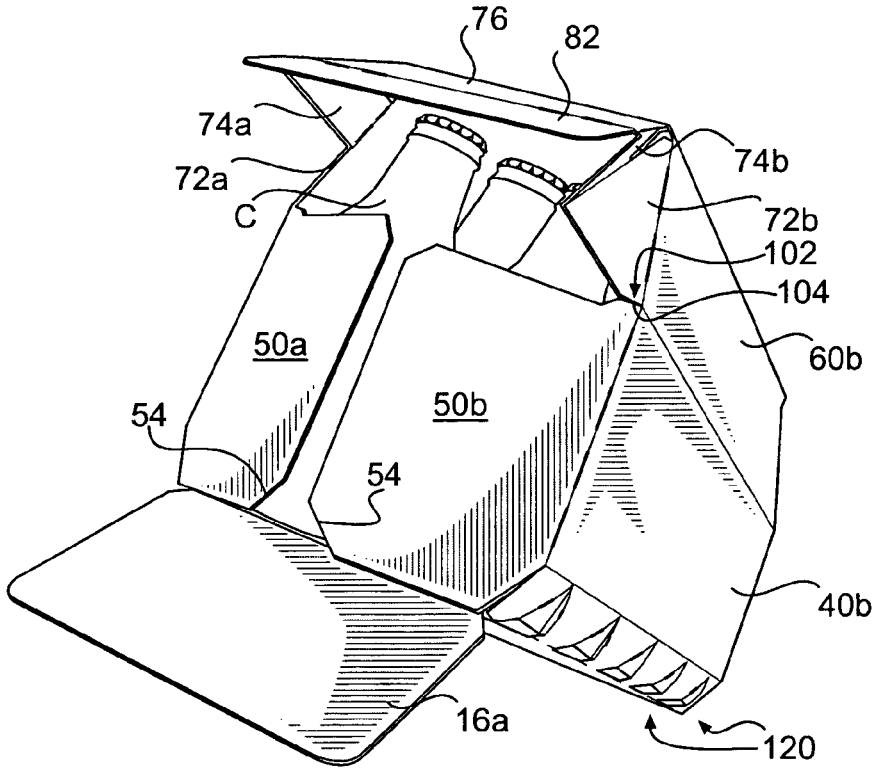
Figure 5:
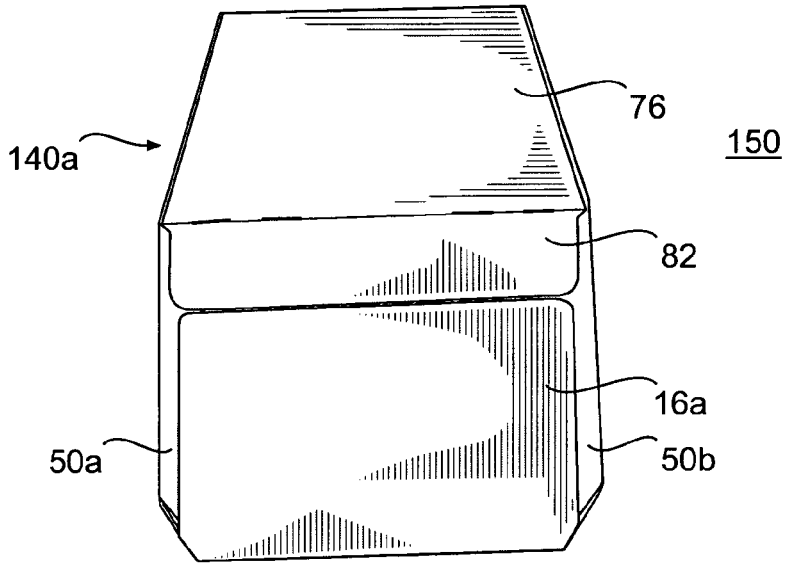
Figure 6:
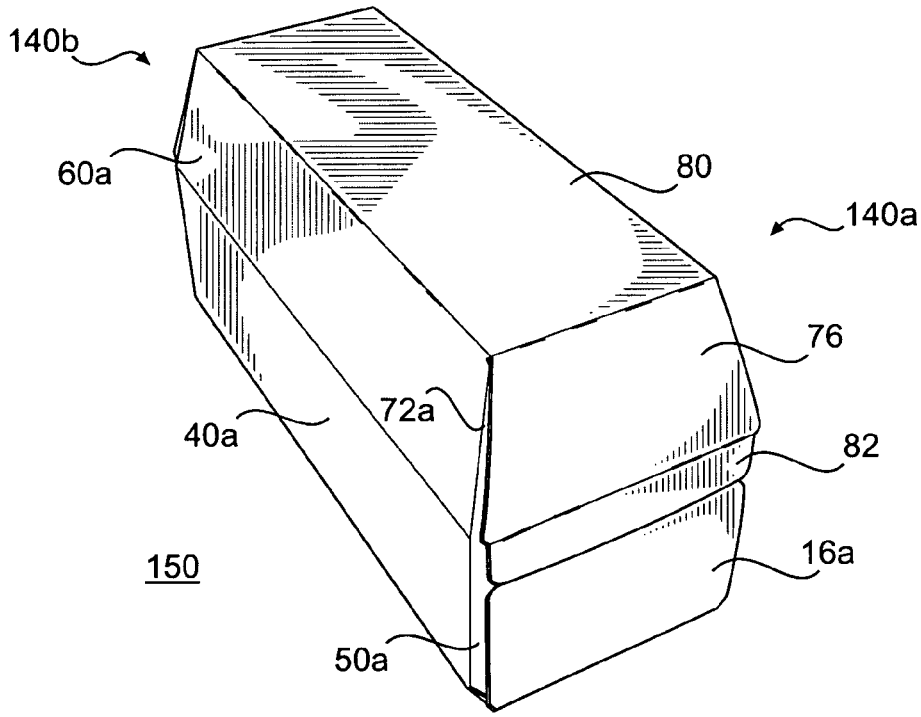
FIG. 6 is a perspective view of the erected carrier.
Figure 7:
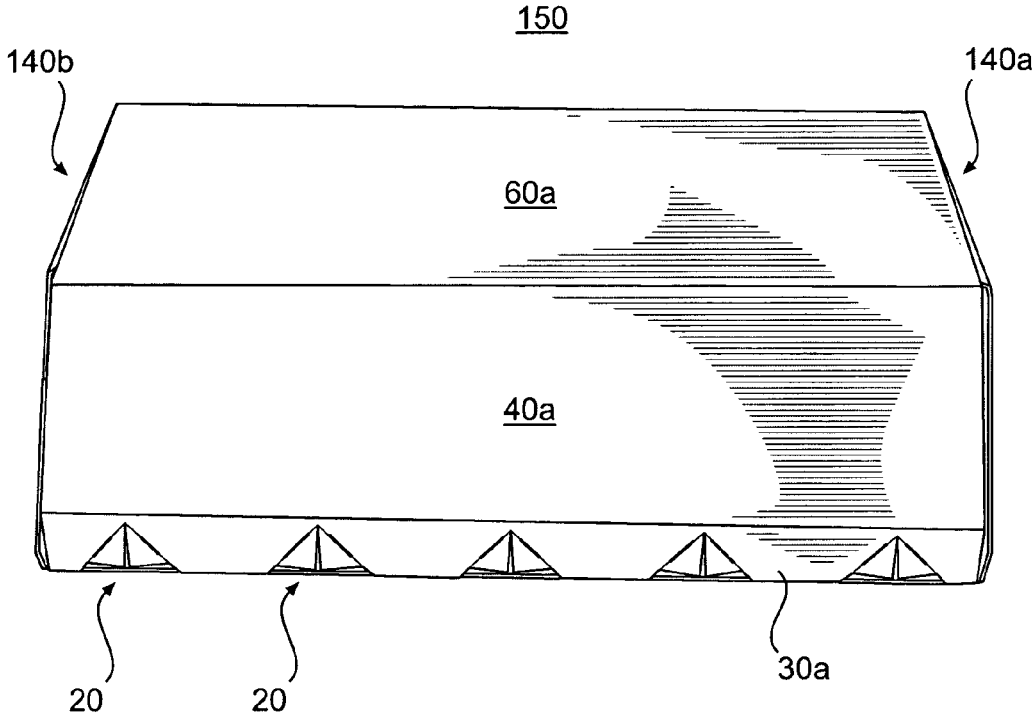
FIG. 7 is a side view of the carrier.
Figure 8:
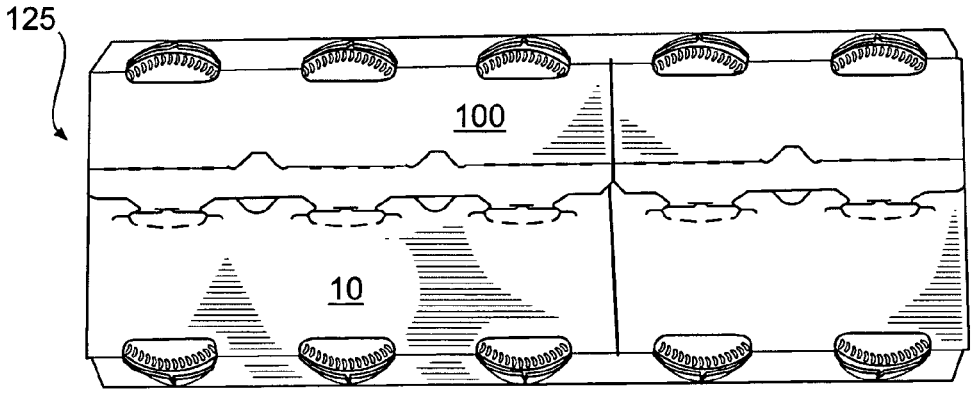
FIG. 8 is a bottom plan view of the carrier.

FIG. 3 illustrates the partially erected carrier 150 after interlocking the bottom panels 10, 100, in which containers C are wrapped within the blank 8. Referring to FIGS. 4 and 5, the first top end closure 70*a* is closed by folding the inner tuck-in gusset panels 72*a*, 72*b* and the outer tuck-in gusset panels 74*a*, 74*b* inwardly and folding the top end flap 76 downwardly. The first and second side end flaps 50*a*, 50*b* are rotated inwardly. The top end closure 70*a* is secured by securing the adhesive flap 82 to the first and second side end flaps 50*a*, 50*b*. The first bottom end flap 16*a* is folded upwardly, and is also secured to the exteriors of the side end flaps 50*a*, 50*b*. The flaps may be secured using, for example, glue or other adhesives. Closing the top end closure 70*a*, the side end flaps 50*a*, 50*b*, and the first bottom end flap 16*a* forms a first end closure 140*a* that may substantially close a first end of the carrier 150, as shown in FIG. 5. The second end of the carrier 150 may be similarly closed by forming a second end closure 140*b* from the top end closure 70*b*, the third and fourth side end flaps 50*c*, 50*d*, and the second bottom end flap 16*b*. FIG. 6 is a perspective view of the erected carrier 150. FIG. 7 is a side view illustrating the first and second end closures 140*a*, 140*b*, and FIG. 8 is a bottom view of the carrier 150. As shown in FIG. 8, when the bottom panels 10, 100 are secured together, they form a bottom panel 125. According to one aspect of the invention, the cuts 104 and nicks 102 at the connection of the panel pairs 50*a*, 72*a*, 50*b*, 72*b*, 50*c*, 72*c*, and 50*d*, 72*d* facilitate closure of the ends of the carton 150. The angled or beveled corners 53, 54 at the bottoms of the side end panels 50*a*, 50*b*, 50*c*, 50*d* facilitate inward rotation of the panels to close the ends of the carton. The bottom edges 56 of the panels 50*a*, 50*b*, 50*c*, 50*d* may be sufficiently close to the bottom panels 10, 100 such that when the panels 50*a*, 50*b*, 50*c*, 50*d* are rotated inwardly, the panels may abut or slide along a surface so that the carton is "squared." In other words, the side end panels 40*a*, 40*b* are brought into a generally vertical alignment by closure of the side end panels 50*a*, 50*b*, 50*c*, 50*d*.

Figure 9:
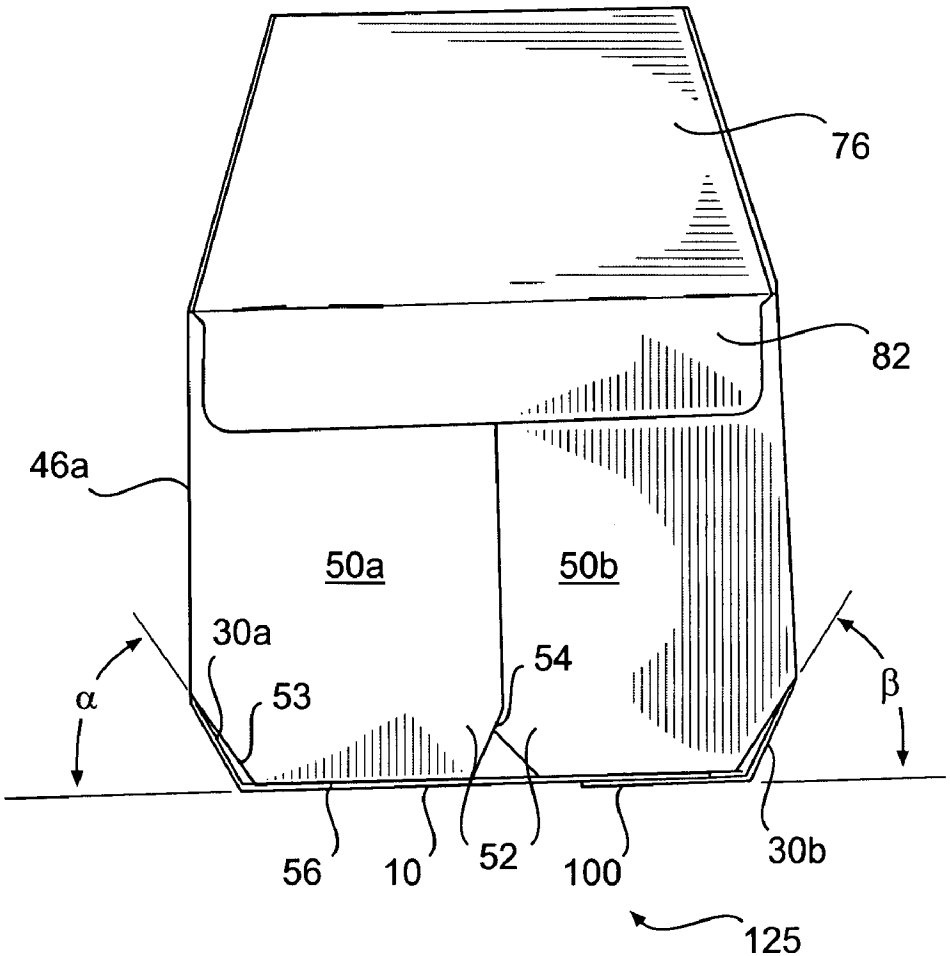
FIG. 9 is a partially exploded view of a first end of the carrier.

FIG. 9 is a partially exploded view of a first end of the carrier 150 with the first bottom flap 16*a* removed, allowing a view of the side end flaps 50*a*, 50*b*. FIG. 9 illustrates the relationship of the first and second side end flaps 50*a*, 50*b* with respect to the bottom panel 125. The first and second side end flaps 50*a*, 50*b*, as well as the third and fourth side end flaps 50*c*, 50*d* at the opposite end of the carrier 150, extend downward to be adjacent and/or abutting the bottom panel 125. For example, the bottom edge 56 of the side end flap 50*a* can be substantially parallel to and abutting or adjacent to the bottom panel 125. The blank 8 can be dimensioned so that when the carrier is 150 erected, the bottom edges 56 of each of the side end flaps 50*a*, 50*b*, 50*c*, 50*d* are adjacent to, and/or partially or wholly abutting, the bottom panel 125. Contact between the bottom edges 56 of the flaps 50*a*, 50*b*, 50*c*, 50*d* and a surface act to square the carrier during erection. Also, when the erected carrier 150 is subjected to torsional or unbalanced axial loads, the interaction between the bottom edges 56 of the side end flaps 50*a*, 50*b*, 50*c*, 50*d* with the bottom panel 125 may stabilize and reinforce the carrier 150.

The inclined corners 53 of the side end flap 50*a*, 50*b* may be inclined with respect to the bottom panel 125 at the angle α, as also shown in FIG. 1. The angle α may, for example, approximate or be smaller than the angle β that the bevel panels 30*a*, 30*b* form with respect to the bottom panel 125. The side end flaps 50*a*, 50*b* therefore do not extend past the bevel panels 30*a*, 30*b* and remain within the end profile of the carrier 150. The third and fourth side end panels 50*c*, 50*d* in the second end closure 140*b* may have configurations similar or identical to those of the first and second side end panels 50*a*, 50*b*.

EXAMPLE 1

A carrier 150 as illustrated in FIGS. 6-8 accommodated ten 25 cl bottles in a 2×5 arrangement. The carrier had a height of about 6.25 in. and a length of about 11.75 in. The carrier was constructed of paperboard. The fold lines 46*a-d*, 48, 77*a*, 77*b*, and 58 were cut/space lines with the cuts extending through the blank 8 (i.e., 100% cuts). The fold lines 32, 62*a*, 82*a*, 102, 62*b*, 82*b* were crease lines. The cuts 104 were 100% cuts.

In the above embodiments, the carrier 150 is shown as accommodating beverage bottles. Other types of containers, however, can be accommodated within a carrier according to the present invention. The dimensions of the blank 8 may also be altered, for example, to accommodate various container forms.

The carrier 150 illustrated above accommodates ten containers C in a 2×5 arrangement. Additional containers C can be accommodated, however, by adjusting the geometry of the blank 8. For example, referring to FIG. 1, the width of the blank 8 along the transverse direction may be increased to accommodate additional rows of containers. In one such embodiment, a carrier may be constructed in accordance with the embodiments discussed above that accommodates twelve containers arranged in a 2×6 arrangement.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank.

In accordance with the exemplary embodiments, the blank may be constructed of paperboard of a caliper such that it is heavier and more rigid than ordinary paper. The blank can also be constructed of other materials, such as cardboard, hard paper, or any other material having properties suitable for enabling the carrier package to function at least generally as described above. The blank can also be laminated to or coated with one or more sheet-like materials at selected panels or panel sections.

For purposes of the description presented herein, the term "line of disruption" can be used to generally refer to either a cut line, a tear line, or a fold line formed in the material (or a combination of at least one cut line, tear line, or fold line). A "breachable" line of disruption is a line of disruption that is intended to be breached during ordinary use of the carrier. An example of a breachable line of disruption is a tear line.

In accordance with the above-described embodiments of the present invention, a fold line can be any substantially linear, although not necessarily straight, line of disruption or other form of weakening that facilitates folding therealong.

In the present specification, a "panel" or "flap" need not be flat or otherwise planar. A "panel" or "flap" can, for example, comprise a plurality of interconnected generally flat or planar sections.

The above embodiments may be described as having one or panels adhered together by glue. The term "glue" is intended to encompass all manner of adhesives commonly used to secure carrier panels in place.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for assembling into a wrap-around carrier, the blank comprising:

a top panel;

a first upper side panel;

a second upper side panel;

a first lower side panel;

a second lower side panel;

at least one bottom panel foldably connected to at least one of the first and second lower side panels, the at least one bottom panel comprising a first bottom panel comprising a first edge and an opposing second edge;

a first bottom end flap foldably connected to the first edge of the first bottom panel;

a second bottom end flap foldably connected to the second edge of the first bottom panel;

a top end closure in a marginal area of the blank;

a first side end flap foldably connected to the first lower side panel, the first side end flap having a first base portion and a first projecting portion extending from the first base portion;

a second side end flap foldably connected to the second lower side panel, the second side end flap having a second base portion and a second projecting portion extending from the second base portion;

a first top end flap foldably connected to the top panel;

a first inner tuck-in gusset panel foldably connected to the first upper side panel; and a first outer tuck-in gusset panel foldably connected to the first inner tuck-in gusset panel and to the first top end flap, wherein the first and second projecting portions extend away from the first top end flap and the first projecting portion has a projection edge that is adjacent to the first bottom end flap.

2. The blank of claim 1, wherein the first projecting portion tapers in a direction away from the first base portion.

3. The blank of claim 2, wherein the first projecting portion extends adjacent to a side edge of the first bottom end flap.

4. The blank of claim 3, wherein the first projecting portion is separated from the first bottom end flap by a first cut line.

5. The blank of claim 4, wherein the first projecting portion is at least partially defined by a first beveled corner adjacent to the first lower side panel and the first base portion of the first side end flap is substantially rectangular.

6. The blank of claim 5, wherein the first lower side panel comprises a first bevel panel defined by substantially parallel fold lines, and wherein the first projecting portion extends adjacent to the first bevel panel.

7. The blank of claim 1, wherein the second projecting portion is at least partially defined by beveled corners and tapers in a direction away from the second base portion and wherein the second projecting portion is adjacent to a side edge of the second bottom end flap.

8. The blank of claim 1, wherein the at least one bottom panel comprises a second bottom panel.

9. The blank of claim 8, further comprising:

a third side end flap foldably connected to the first lower side panel; and a fourth side end flap foldably connected to the second lower side panel.

10. The blank of claim 9, wherein the third side end flap has a third base portion and a third projecting portion extending from the third base portion, and wherein the third projecting portion tapers in a direction away from the third base portion.

11. The blank of claim 1, further comprising:

at least one dispenser flap in the top panel;

at least one heel cutout adjacent to the first lower side panel; and at least one heel cutout adjacent to the second lower side panel.

12. The blank of claim 1, wherein the first inner tuck-in gusset panel is connected to the first side end flap at a nick and a cut.

13. The blank of claim 1, wherein the projection edge of the first projecting portion is a bottom edge that abuts a side edge of the first bottom end flap.

14. The blank of claim 1, the at least one bottom panel comprising a second bottom panel, which comprises a plurality of primary male locking projections and secondary male locking projections, wherein the secondary male locking projections are situated generally in between the primary male locking projections.

15. The blank of claim 1, wherein the first edge comprises a first marginal edge of the first bottom panel and the second edge comprises an opposing second marginal edge of the first bottom panel.

16. A blank for assembling into a wrap-around carrier, the blank comprising:

a top panel;

a first upper side panel foldably connected to the top panel;

a second upper side panel foldably connected to the top panel;

a first lower side panel foldably connected to the first upper side panel, wherein the first lower side panel comprises a first bevel panel defined by substantially parallel fold lines;

a second lower side panel foldably connected to the second upper side panel, wherein the second lower side panel comprises a second bevel panel defined by substantially parallel fold lines;

at least one bottom panel foldably connected to at least one of the first and second lower side panels, the at least one bottom panel comprising a first bottom panel;

a first bottom end flap foldably connected to one edge of the first bottom panel;

a second bottom end flap foldably connected to an opposing edge of the first bottom panel;

a top end closure in a marginal area of the blank;

a first side end flap foldably connected to the first lower side panel, the first side end flap having a first base portion and a first projecting portion extending from the first base portion, wherein the first projecting portion extends adjacent to the first bevel panel;

a second side end flap foldably connected to the second lower side panel, the second side end flap having a second base portion and a second projecting portion extending from the second base portion;

a first top end flap foldably connected to the top panel;

a first inner tuck-in gusset panel foldably connected to the first upper side panel; and a first outer tuck-in gusset panel foldably connected to the first inner tuck-in gusset panel and to the first top end flap, wherein the first projecting portion extends from the first base portion in a direction away from the first top end flap and tapers in a direction away from the first base portion, the first projecting portion having a projection edge that is adjacent to the first bottom end flap, and the second projecting portion extends from the second base portion in a direction away from the first top end flap.

17. The blank of claim 16, wherein the second projecting portion tapers in a direction away from the first top end flap.

18. The blank of claim 17, further comprising:

a third side end flap foldably connected to the first lower side panel, wherein the third side end flap comprises a third base portion and a third tapered projecting portion extending from the third base portion; and a fourth side end flap foldably connected to the second lower side panel, wherein the fourth side end flap comprises a fourth base portion and a fourth tapered projecting portion extending from the fourth base portion.

19. The blank of claim 16, wherein the first inner tuck-in gusset panel is connected to the first side end flap at a nick and a cut.

20. The blank of claim 16, wherein the one edge of the bottom panel comprises a first marginal edge of the bottom panel and the opposing edge of the bottom panel comprises an opposing second marginal edge of the bottom panel.

21. A carrier, comprising:

a carton, comprising:

a top panel;

a first upper side panel;

a second upper side panel disposed on a side of the carrier opposite to the first upper side panel;

a first lower side panel;

a second lower side panel disposed on a side of the carrier opposite to the first lower side panel;

a bottom panel comprising a first bottom panel secured to a second bottom panel, the bottom panel comprising a lowermost portion of the carrier;

a first end closure closing a first end of the carrier, the first end closure comprising:

a first side end flap foldably connected to the first lower side panel, the first side end flap having a first bottom edge abutting the bottom panel, at the lowermost portion of the carrier;

a second side end flap, the second side end flap having a bottom edge located adjacent to the bottom panel;

a first top end flap foldably connected to the top panel;

a first inner tuck-in gusset panel foldably connected to the first upper side panel;

a first outer tuck-in gusset panel foldably connected to the first inner tuck-in gusset panel; and a first bottom end flap foldably connected to one end of the first bottom panel; and a second end closure closing a second end of the carrier; and a plurality of containers located within the carton.

22. The carrier of claim 21, wherein the first side end flap comprises a first base portion and a first projecting portion, the first bottom edge being a bottom edge of the first projecting portion.

23. The carrier of claim 22, wherein the first projecting portion is at least partially defined by a first beveled corner and the first base portion of the first side end flap is substantially rectangular.

24. The carrier of claim 22, wherein the first lower side panel comprises a first bevel panel defined by substantially parallel fold lines, and wherein the first projecting portion is at least partially defined by a first beveled corner extending adjacent to the first bevel panel.

25. The carrier of claim 24, wherein the first bevel panel forms a first angle with respect to the bottom panel, and the first beveled corner forms a second angle with respect to the bottom panel, wherein the first angle is greater than the second angle.

26. The carrier of claim 21, wherein the first side end flap is tapered near the bottom panel.

27. The carrier of claim 21, wherein the second end closure comprises:

a third side end flap foldably connected to the first lower side panel, wherein a third bottom edge of the third side end flap is adjacent to the bottom panel; and a fourth side end flap foldably connected to the second lower side panel.

28. The carrier of claim 27, further comprising:

at least one dispenser flap in the top panel;

at least one heel cutout adjacent to the first lower side panel; and at least one heel cutout adjacent to the second lower side panel, wherein the first inner tuck-in gusset panel is connected to the first side end flap at a nick and a cut.

29. The carrier of claim 21, wherein the plurality of containers comprises at least six containers arranged in at least two columns and at least three rows.

30. The carrier of claim 21, wherein the first inner tuck-in gusset panel is connected to the first side end flap at a nick and a cut.

31. The carrier of claim 21, the second bottom panel comprising a plurality of primary male locking projections and secondary male locking projections, wherein the secondary male locking projections are situated generally in between the primary male locking projections.

32. The carrier of claim 21, wherein the first bottom end flap at least partially overlaps with the first and second side end flaps.

* * * * *